US011352235B2

(12) United States Patent
Kattainen et al.

(10) Patent No.: US 11,352,235 B2
(45) Date of Patent: Jun. 7, 2022

(54) METHOD, A SAFETY CONTROL UNIT, AND AN ELEVATOR SYSTEM FOR VERIFYING SPEED DATA OF AN ELEVATOR CAR FOR OVERSPEED MONITORING OF THE ELEVATOR CAR

(71) Applicant: Kone Corporation, Helsinki (FI)

(72) Inventors: Ari Kattainen, Helsinki (FI); Antti Hovi, Helsinki (FI)

(73) Assignee: Kone Corporation, Helsinki (FI)

( * ) Notice: Subject to any disclaimer, the term of this patent is extended or adjusted under 35 U.S.C. 154(b) by 937 days.

(21) Appl. No.: 16/131,170

(22) Filed: Sep. 14, 2018

(65) Prior Publication Data

US 2019/0010024 A1 Jan. 10, 2019

Related U.S. Application Data

(63) Continuation of application No. PCT/FI2016/050198, filed on Mar. 30, 2016.

(51) Int. Cl.
*B66B 5/00* (2006.01)
*B66B 1/28* (2006.01)
(Continued)

(52) U.S. Cl.
CPC ..... *B66B 5/0031* (2013.01); *B66B 1/28* (2013.01); *B66B 1/3446* (2013.01); *B66B 5/027* (2013.01); *B66B 5/06* (2013.01); *B66B 1/32* (2013.01)

(58) Field of Classification Search
CPC .... B66B 5/00; B66B 5/04; B66B 1/28; B66B 1/3492; B66B 5/0031; B66B 1/30;
(Continued)

(56) References Cited

U.S. PATENT DOCUMENTS

2008/0135342 A1* 6/2008 Thumm ..... B66B 1/32 187/247
2008/0202862 A1* 8/2008 Dudde ..... G01D 5/2451 187/393
(Continued)

FOREIGN PATENT DOCUMENTS

CN 101023016 A 8/2007
CN 101094802 A 12/2007
(Continued)

OTHER PUBLICATIONS

Chinese Office Action dated Aug. 22, 2019, issued in corresponding Chinese Patent Application No. 201680084212.X.
(Continued)

*Primary Examiner* — Marlon T Fletcher
(74) *Attorney, Agent, or Firm* — Harness, Dickey & Pierce, P.L.C.

(57) ABSTRACT

The invention relates to a method for verifying speed data of an elevator car for overspeed monitoring of the elevator car. The method comprising obtaining at least one continuous speed data of the elevator car at two channels; obtaining a zone speed data of the elevator car within at least one zone of an elevator shaft at two channels, generating a two-channel verified speed information by comparing the said at least one continuous speed data to the zone speed data at least at one channel; generating a control signal, if the comparison indicates a mismatch at least at one channel; and if the comparison indicates a match at each of the at least one channel in which the comparison is provided; the method further comprising comparing the verified speed information at each channel between each other; and generating the control signal, if the reciprocal comparison indicates a mismatch. The invention also relates to a safety control unit
(Continued)

and an elevator system performing at least partly the method.

15 Claims, 5 Drawing Sheets

(51) Int. Cl.
*B66B 5/06* (2006.01)
*B66B 5/02* (2006.01)
*B66B 1/34* (2006.01)
*B66B 1/32* (2006.01)

(58) Field of Classification Search
CPC ..... B66B 1/285; B66B 1/32; B66B 5/0018; B66B 5/044; B66B 5/028
See application file for complete search history.

(56) References Cited

U.S. PATENT DOCUMENTS

2009/0255762 A1* 10/2009 Ketonen ..... B66B 13/22 187/247
2011/0147135 A1 6/2011 Birrer et al.
2015/0014098 A1 1/2015 Stolzl et al.
2015/0083528 A1* 3/2015 Kattainen ..... B66B 5/0031 187/393
2015/0274487 A1 10/2015 Annen et al.
2018/0162684 A1* 6/2018 Hsu ..... B66B 1/24
2018/0229965 A1* 8/2018 Kattainen ..... B66B 1/3492
2019/0010024 A1* 1/2019 Kattainen ..... B66B 1/28
2019/0248625 A1* 8/2019 Mustonen ..... B66B 5/0037
2019/0352130 A1* 11/2019 Jussila ..... B66B 5/0031
2020/0198929 A1* 6/2020 Michel ..... G01D 5/142
2021/0309487 A1* 10/2021 Kauppinen ..... B66B 19/007

FOREIGN PATENT DOCUMENTS

CN 100415625 C 9/2008
CN 102666341 A 9/2012
CN 104718148 A 6/2015
EP 1602610 A1 12/2005

OTHER PUBLICATIONS

International Search Report PCT/ISA/210 for International Application No. PCT/FI2016/050198 dated Jul. 13, 2016.
Written Opinion of the International Searching Authority PCT/ISA/237 for International Application No. PCT/FI2016/050198 dated Jul. 13, 2016.

* cited by examiner

METHOD, A SAFETY CONTROL UNIT, AND AN ELEVATOR SYSTEM FOR VERIFYING SPEED DATA OF AN ELEVATOR CAR FOR OVERSPEED MONITORING OF THE ELEVATOR CAR

This application is a continuation of PCT International Application No. PCT/FI2016/050198 which has an International filing date of Mar. 30, 2016, the entire contents of which are incorporated herein by reference.

TECHNICAL FIELD

The invention concerns in general the technical field of an elevator technology. Especially the invention concerns enhancing the safety of the elevators.

BACKGROUND

Typically an elevator comprises an elevator car and a hoisting machine configured to drive the elevator car in an elevator shaft between landings. Speed of the elevator car should be proportioned such that the elevator car may be stopped at a desired floor or landing. For a safety reason, the speed of the elevator car is monitored. If the elevator car is detected to move at an overspeed the movement of the elevator car is instructed to be decelerated or stopped. In particular, the speed monitoring is important in case of service drive or electrical rescue drive function (RDF) from the safety aspect.

For example, in case of a power failure brakes of the elevator car are activated in order to stop the movement of the elevator car. In a manual rescue drive the brakes are manually released in order to move the elevator car to a landing and the speed of the elevator car may be manually monitored while the elevator car is moving. In the electrical rescue drive function the electric brakes may be electrically released and an automatic monitoring for the overspeed of the elevator car may be required.

During the service drive or electrical rescue drive function the overspeed monitoring is required to be at least two-channel monitoring. Furthermore, the overspeed monitoring is required to be implemented by means of a component that fulfills the accuracy requirements. A Safety Integrity Level (SIL) may be used to indicate a tolerable failure rate of a particular safety function, for example a safety component. SIL is defined as a relative level of risk-reduction provided by the safety function, or to specify a target level of risk reduction. SIL has a number scheme from 1 to 4 to represent its levels. The higher the SIL level is, the greater the impact of a failure is and the lower the failure rate that is acceptable is.

According to a prior art solution the speed of the elevator car may be monitored by monitoring the speed of the elevator car obtained by means of a motor encoder or an absolute position sensor connected to the elevator car, for example. However, one drawback of the prior art solution may be that the SIL level of the overspeed monitoring is too low, for example 2 or less. Furthermore, the monitoring may not be two-channel monitoring. According to another example of prior art solution a two-channel monitoring may be provided at door zones of the elevator shaft. One drawback of such prior art solution is that the overspeed monitoring is provided only within a part of the elevator shaft. Thus, there is a need to develop further solutions for improving the safety of the elevator systems.

SUMMARY

An objective of the invention is to present a method, a safety control unit, and an elevator system for verifying speed data of an elevator car. Another objective of the invention is that the method, the safety control unit, and the elevator system for verifying speed data of an elevator car improve the safety of the elevator system.

The objectives of the invention are reached by a method, a safety control unit, and an elevator system as defined by the respective independent claims.

According to a first aspect, a method for verifying speed data of an elevator car for overspeed monitoring of the elevator car is provided, the method comprising: obtaining at least one continuous speed data of the elevator car at two channels; obtaining a zone speed data of the elevator car within at least one zone of an elevator shaft at two channels; generating a two-channel verified speed information by verifying the validity of the at least one continuous speed data by comparing the said at least one continuous speed data to the zone speed data at least at one channel, preferably at both channels, when the zone speed data is available; generating a control signal for a safety device, if the comparison indicates a mismatch between the zone speed data and the at least one continuous speed data at least at one channel in which the comparison is provided; and if the comparison indicates a match between the zone speed data and the at least one continuous speed data at each of the at least one channel in which the comparison is provided, the method further comprising: comparing the verified speed information at each channel between each other by reciprocal comparison; and generating the control signal for the safety device, if the reciprocal comparison indicates a mismatch between the verified speed information at the channels.

Alternatively or in addition, if the reciprocal comparison indicates a match between the verified speed information at the channels, the method may further comprise: determining if the verified speed information meets a predetermined overspeed limit at least at one channel; and generating the control signal for the safety device, if the verified speed data meets the predetermined overspeed limit at least at one channel.

Alternatively, if two or more continuous speed data of the elevator car at least at one channel are obtained, the method may further comprise: comparing continuously the two or more continuous speed data with each other at least at one channel; and generating the control signal for the safety device, if the comparison indicates a mismatch between the two or more continuous speed data at least at one channel.

The zone speed data may obtained by means of at least one Hall sensor at each channel and at least one magnet at the zone. The at least one zone of the elevator shaft may be a door zone.

The at least one continuous speed data of the elevator car may be obtained by means of at least one of the following: at least one accelerometer, at least one encoder mounted in a hoisting motor.

The control signal may comprise an instruction to stop the movement of the elevator car.

According to a second aspect, a safety control unit for verifying speed data of an elevator car for overspeed monitoring of the elevator car is provided, wherein the safety control unit is communicatively coupled to a safety device, the safety control unit comprising: at least one processor; and at least one memory storing at least one portion of computer program code, wherein the at least one processor being configured to cause the elevator control unit at least to perform: obtain at least one continuous speed data of the elevator car at two channels; obtain a zone speed data of the elevator car within at least one zone of an elevator shaft at two channels; generate a two-channel verified speed information by verifying the validity of the at least one continuous speed data by comparing the said at least one continuous speed data to the zone speed data at least at one channel, preferably at both channels, when the zone speed data is available; generate a control signal for a safety device, if the comparison indicates a mismatch between the zone speed data and the at least one continuous speed data at least at one channel in which the comparison is provided; and if the comparison indicates a match between the zone speed data and the at least one continuous speed data at each of the at least one channel in which the comparison is provided, the safety control unit is further configured to: compare the verified speed information at each channel between each other by reciprocal comparison; and generate the control signal for the safety device, if the reciprocal comparison indicates a mismatch between the verified speed information at the channels.

Alternatively or in addition, if the reciprocal comparison indicates a match between the verified speed information at the channels, the safety control unit may further be configured to: determine if the verified speed information meets a predetermined overspeed limit at least at one channel; and generate the control signal for the safety device, if the verified speed data meets the predetermined overspeed limit at least at one channel.

Alternatively, if two or more continuous speed data of the elevator car at least at one channel are obtained, the safety control unit may further be configured to: compare continuously the two or more continuous speed data with each other at least at one channel; and generate the control signal for the safety device, if the comparison indicates a mismatch between the two or more continuous speed data at least at one channel.

The zone speed data may be determined by means of at least one Hall sensor at each channel and at least one magnet at the zone. The at least one zone of the elevator shaft may be a door zone.

The obtained at least one continuous speed data of the elevator car may be obtained by means of at least one of the following: at least one accelerometer, at least one encoder mounted in a hoisting motor.

The control signal may comprise an instruction to stop the movement of the elevator car.

According to a third aspect, an elevator system for verifying speed data of an elevator car for overspeed monitoring of the elevator car is provided, the elevator system comprising: a safety device for controlling the movement of the elevator car; at least one sensor unit; a safety control unit configured to: obtain at least one continuous speed data of the elevator car at two channels from at least one sensor unit; obtain a zone speed data of the elevator car within at least one zone of an elevator shaft at two channels from at least one sensor unit; generate a two-channel verified speed information by verifying the validity of the at least one continuous speed data by comparing the said at least one continuous speed data to the zone speed data at least at one channel, preferably at both channels, when the zone speed data is available; generate a control signal for the safety device, if the comparison indicates a mismatch between the zone speed data and the at least one continuous speed data at least at one channel in which the comparison is provided; and if the comparison indicates a match between the zone speed data and the at least one continuous speed data at each of the at least one channel in which the comparison is provided, the safety control unit is further configured to: compare the verified speed information at each channel between each other by reciprocal comparison; and generate the control signal for the safety device, if the reciprocal comparison indicates a mismatch between the verified speed information at the channels, wherein the safety control unit, the at least one sensor unit and the safety device are communicatively coupled to each other, and wherein the safety control unit is configured to deliver the generated control signal to the safety device.

The exemplary embodiments of the invention presented in this patent application are not to be interpreted to pose limitations to the applicability of the appended claims. The verb "to comprise" is used in this patent application as an open limitation that does not exclude the existence of also un-recited features. The features recited in depending claims are mutually freely combinable unless otherwise explicitly stated.

The novel features which are considered as characteristic of the invention are set forth in particular in the appended claims. The invention itself, however, both as to its construction and its method of operation, together with additional objectives and advantages thereof, will be best understood from the following description of specific embodiments when read in connection with the accompanying drawings.

BRIEF DESCRIPTION OF FIGURES

The embodiments of the invention are illustrated by way of example, and not by way of limitation, in the figures of the accompanying drawings.

DESCRIPTION OF SOME EMBODIMENTS

Figure 1:
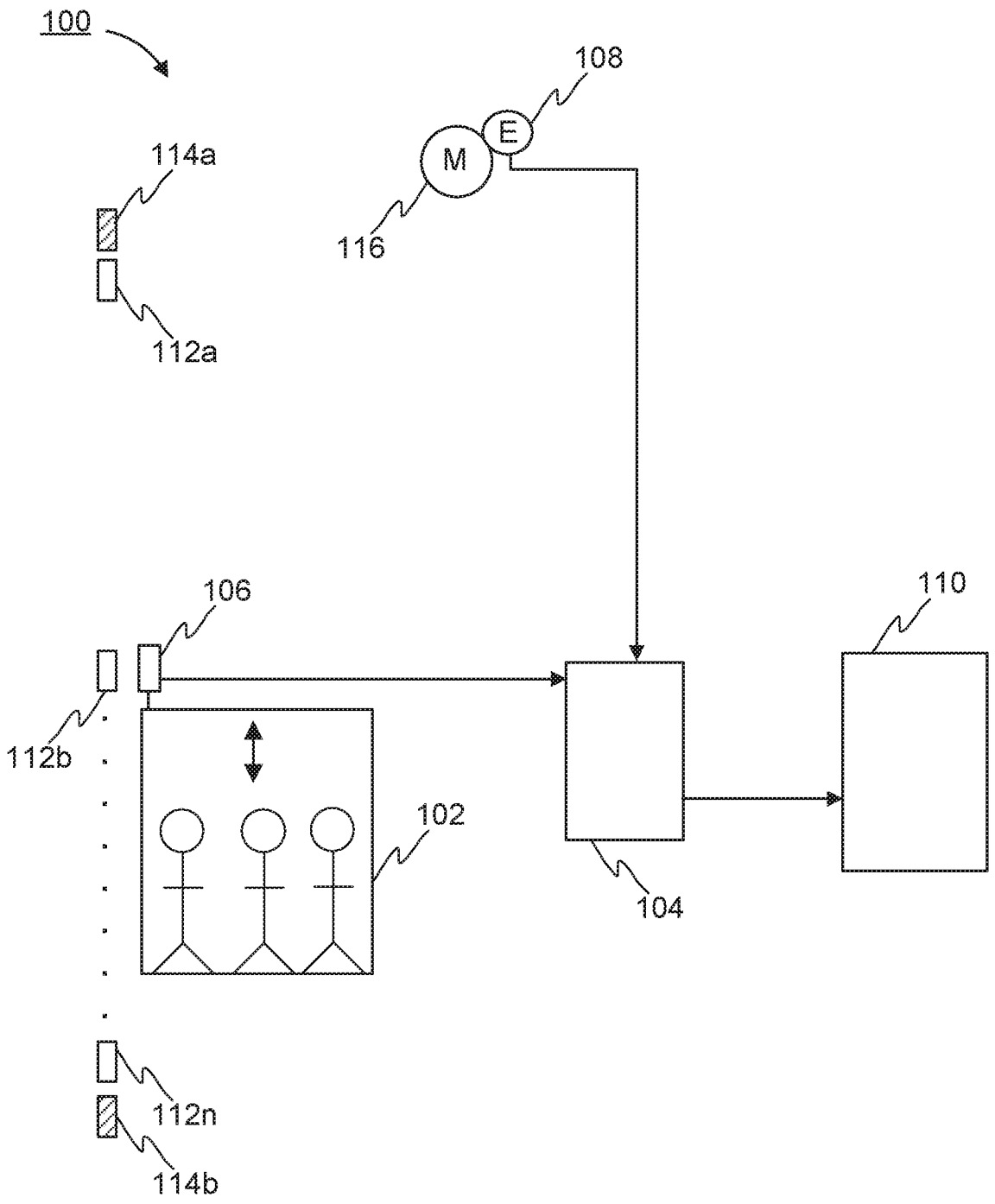
FIG. 1 illustrates an elevator system, wherein the embodiments of the invention may be implemented.

FIG. 1 schematically an elevator system 100, wherein the embodiments of the invention may be implemented as will be described. The elevator system 100 comprises an elevator car 102, a safety control unit 104, at least one sensor unit 106, 108, and a safety device 110. The at least one sensor unit may be fixed to the elevator car 102, for example on the roof of the elevator car 102, as the sensor unit 106 in FIG. 1. Alternatively, the at least one sensor unit 106 may be fixed below the floor of the elevator car 102 or to a door frame of the elevator car 102. Additionally, at least one sensor unit may be mounted in a hoisting motor as the sensor unit 108 in FIG. 1. In FIG. 1 the elevator car 102 is moving in vertical direction inside an elevator shaft (not shown in FIG. 1). The at least one sensor unit 106, 108 is communicatively coupled to the safety control unit 104, which is further communicatively coupled to the safety device 110. The communicatively coupling may be provided via an internal bus, for example. Preferably, the communicatively coupling may be provided via a serial bus. Furthermore, the elevator system comprises at least one magnet 112*a*-112*n* at least at one zone of the elevator shaft fixed to the elevator shaft. Preferably, the at least one magnet may be fixed to a landing door frame in the elevator shaft. Alternatively or in addition, the elevator system according to the invention may comprise at least one magnet 114*a*, 114*b* at least at one terminal landing of the elevator shaft. The at least one terminal landing may be the top or bottom landing.

Figure 2A:
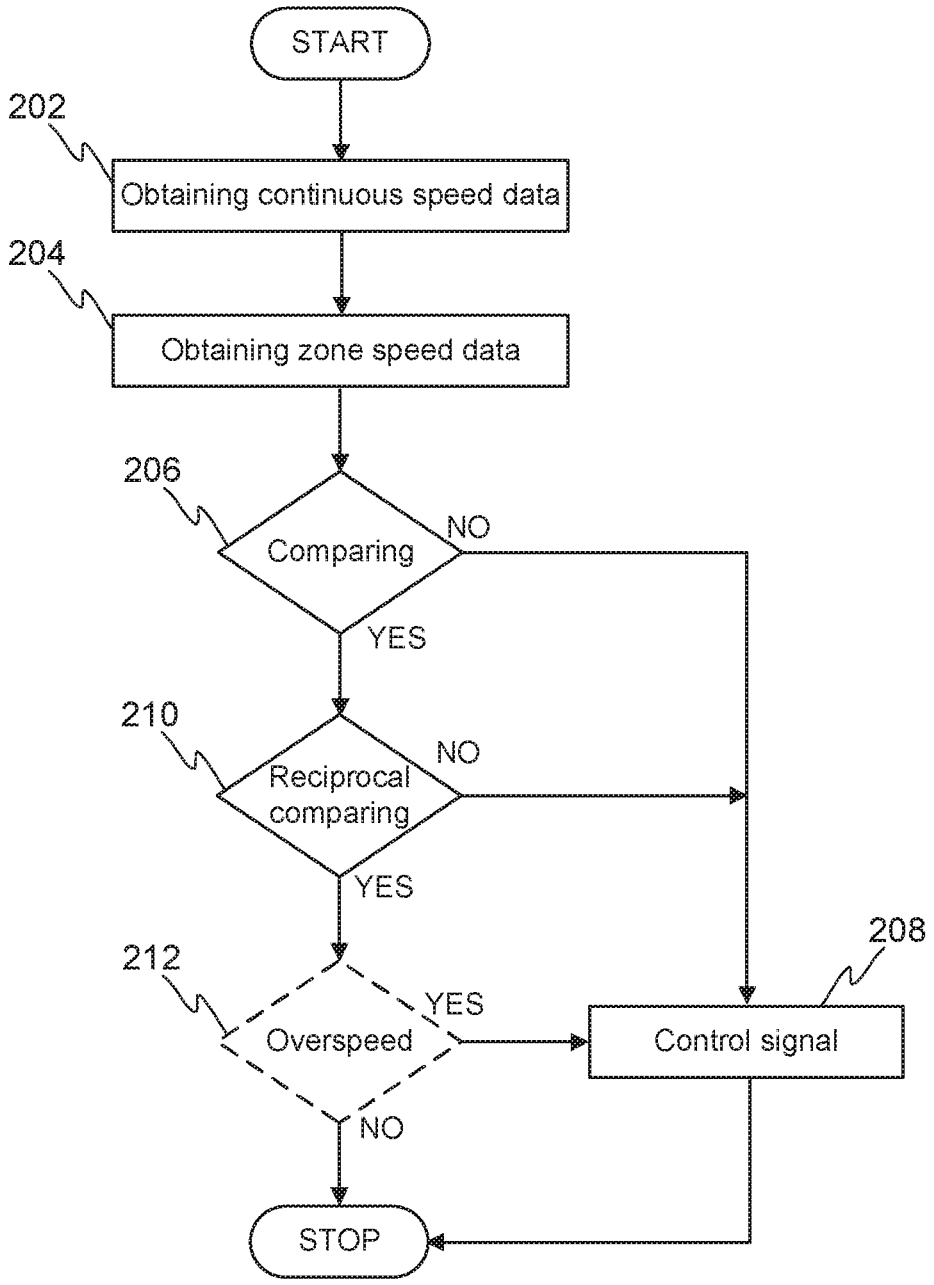
FIG. 2A illustrates schematically an example of the method according to the invention.

Next an example of the method according to the invention is described by referring to FIG. 2A. FIG. 2A schematically illustrates the invention as a flow chart. At least one continuous speed data of the elevator car is obtained at two channels from at least one sensor unit 106, 108 at the step 202. Furthermore, a zone speed data of the elevator car 102 is obtained within at least one zone of an elevator shaft at two channels from at least one sensor unit 106 that may be fixed to the elevator car at step 204.

The at least one continuous speed data of the elevator car may be obtained continuously regardless of the place of the elevator car in the elevator shaft. The at least one continuous speed data of the elevator car may be obtained, for example, by means of at least one of the following: at least one accelerometer, at least one encoder mounted in a hoisting motor. The at least one continuous speed data may be obtained by means of the at least one accelerometer or at least one encoder mounted in a hoisting motor with some known manner. The at least one sensor unit 106 that may be fixed to the elevator car may comprise the at least one accelerometer as will be described later. Alternatively or in addition, the at least one sensor unit 108 may comprise the at least one encoder mounted in the hoisting motor. The continuous speed data may be obtained directly from the at least one encoder as illustrated in FIG. 1. Alternatively, the continuous speed data may be obtained via a drive communicatively coupled to the at least one encoder. The at least one continuous speed data may be obtained from a same source at the both channels, if at least one continuous speed data is obtained from another source at least at one channel. For example, continuous speed data at both channels may be obtained from one accelerometer, if continuous speed data is also obtained from at least one encoder mounted in a motor at least at one channel. Alternatively or in addition, the at least one continuous speed data may be obtained from different sources at each channels. For example, the continuous speed data at channel one may be obtained from one accelerometer and the continuous speed data at channel two may be obtained from another accelerometer. In another example, at channel one the continuous speed data may be obtained from one accelerometer and from at least one encoder mounted in a motor. At channel two, in turn, the continuous speed data may be obtained from another accelerometer and from the said at least one encoder mounted in a motor. The above presented combinations of the sources for obtaining the at least one continuous speed at two channels are only examples and other combinations may be possible.

The zone speed data may be obtained only within at least one zone of an elevator shaft. Hence, the zone speed data is not available continuously along the elevator shaft. The zone speed data is available only within at least one zone of an elevator shaft. The at least one zone of the elevator shaft may be a door zone. The door zone may be defined as a zone extending from a lower limit below floor level to an upper limit above the floor level in which the landing and car door equipment are in mesh and operable. The door zone may be determined to be from −400 mm to +400 mm for example. Preferably, the door zone may be from −150 mm to +150 mm. The at zone speed data may be obtained by means of at least one Hall sensor at each channel and the at least one magnet at the zone. The at least one sensor unit 106 that may be fixed to the elevator car may comprise the at least one Hall sensor as will be described later. The zone speed data at each channel is obtained by means of a different at least one Hall sensor. The zone speed data at a zone may be obtained with some known manner from a parameter obtained from the at least one Hall sensor. For example, obtaining a voltage from the at least one Hall sensor of the sensor unit. The obtained voltage is dependent on the at least one Hall sensor bypassing the at least one magnet at the said zone. Alternatively, the zone speed data may be defined from a rate of change of a linear position of the elevator car 102 obtained by the at least one Hall sensor as the elevator car 102 comprising the sensor unit 106 bypasses the at least one magnet at the said zone.

The zone speed data may be considered as substantially accurate and reliable speed information of the elevator car. The at least one continuous speed information, in turn, may not be considered as reliable and as accurate speed information of the elevator car as the zone speed data. However, the zone speed data is available only within the at least one zone of an elevator shaft.

At the step 206, a two-channel verified speed information is generated by verifying the validity of the at least one continuous speed data. The validity of the at least one continuous speed data is verified by comparing the said at least one continuous speed data to the zone speed data at least at one channel, preferably at both channels. The verified speed information is continuous speed information, which is confirmed to be valid in comparison with the zone speed data. The zone speed data is considered to be substantially accurate and reliable, thus the verified speed information may also be considered to be substantially accurate and reliable. The comparison may be done only, when the zone speed data is available. The zone speed data is available only when the elevator car is within the at least one zone. In the comparison at the step 206 the zone speed data is compared to the at least one continuous speed data at the same moment of time. The two-channel verified data may be provided by the comparison at step 206, which may be done at least at one channel. Alternatively, the two-channel verified data may be provided by the comparison at step 206, which may be done separately at the two channels, so that the zone speed data and the at least one continuous speed data at channel one are compared with each other and the zone speed data and the at least one continuous speed data at channel two are compared with each other. Thus, the two-channel verified speed information may comprise confirmed continuous speed data at both channels or alternatively at one channel. If the comparison indicates a mismatch between the zone speed data and the at least one continuous speed data at least at one channel in which the comparison is provided, a control signal for a safety device is generated at step 208. If a control signal is generated the steps 210-212 are not performed. Alternatively, if the comparison indicates a match between the zone speed data and the at least one continuous speed data at each of the at least one channel in which the comparison is provided, the verified speed information at each channel are compared with each other by reciprocal comparison at the step 210. If the reciprocal comparison indicates a mismatch between the verified speed information at the channels, the control signal is generated for the safety device at the step 208.

Alternatively or in addition, if the reciprocal comparison indicates a match between the verified speed information at the channels, it may be determined does the verified speed information meets a predetermined overspeed limit at least at one channel at the step 212. If the verified speed data meets the predetermined overspeed limit at least at one channel, the control signal for a safety device is generated at the step 208. The predetermined overspeed limit may be defined to be a certain percent, such as 120 percent for example, of the nominal speed of the elevator car. Preferably the overspeed limit is below safety device trigger speed.

Figure 2B:
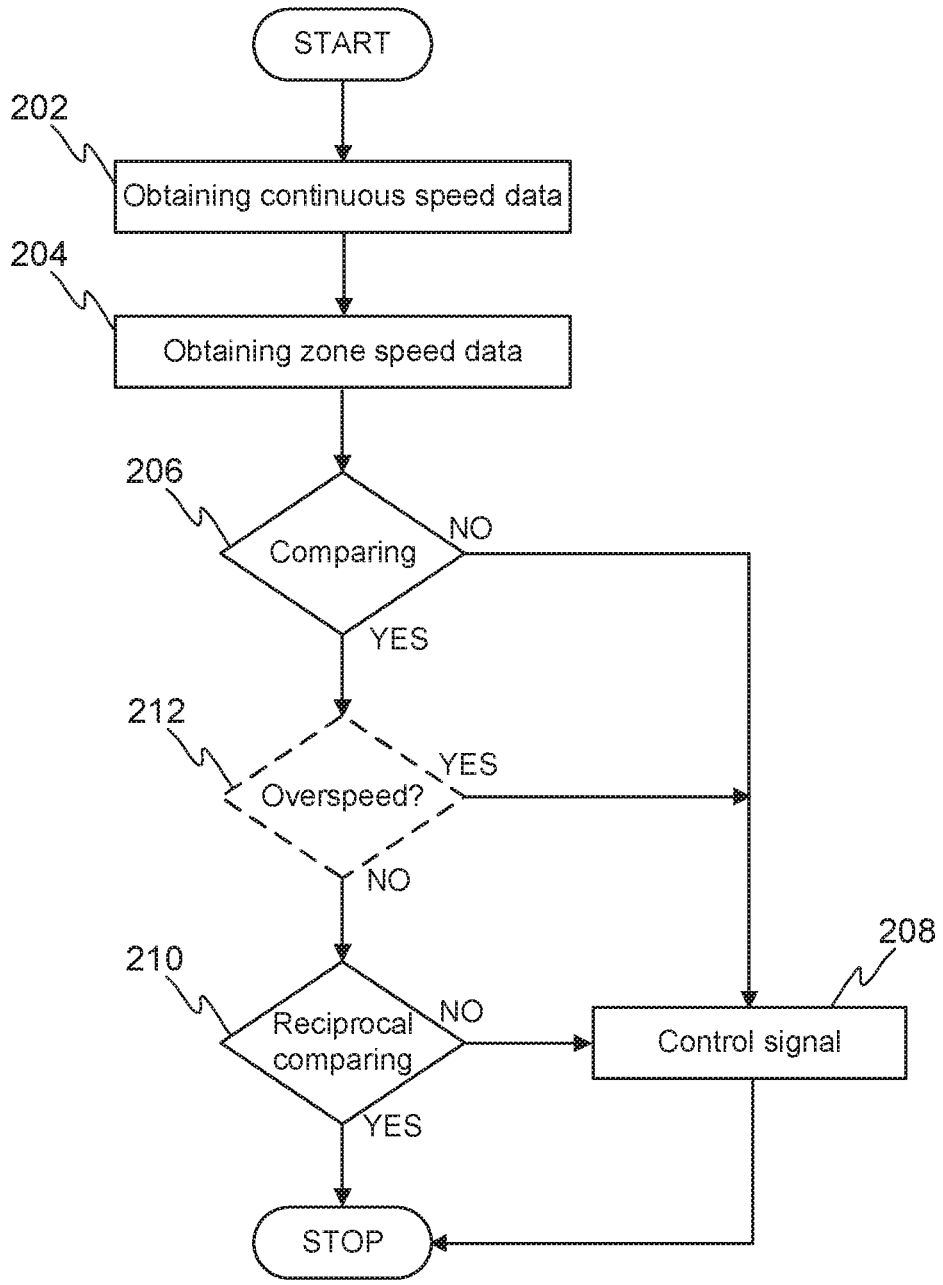
FIG. 2B illustrates schematically another example of the method according to the invention.

The steps 210 and 212 may be performed in alternative order, so that either step 210 or step 212 may be performed first. FIG. 2A illustrates the flow chart of the method so that the step 210 is performed before step 212. If the step 212 is performed before step 210 and the control signal is generated after the step 212, the step 210 is not performed. FIG. 2B illustrates a flow chart of the method so that the step 212 is performed before the step 210.

Additionally, if two or more continuous speed data are obtained from different sources at least at one channel at step 202, the two or more continuous speed data may be compared continuously with each other at least at one channel. If the comparison indicates a mismatch between the two or more continuous speed data at least at one channel, the control signal for a safety device is generated. If a control signal is generated the following steps are not performed. Alternatively, if the comparison indicates a match between the two or more continuous speed data at least at one channel, the method continues so that at least one of the two or more continuous speed data are compared to the zone speed data at step 206.

The control signal may comprise an instruction for the safety device 110 to stop the movement of the elevator car 102. The safety device 110 is configured to control the movement of the elevator car 102.

Figure 3:
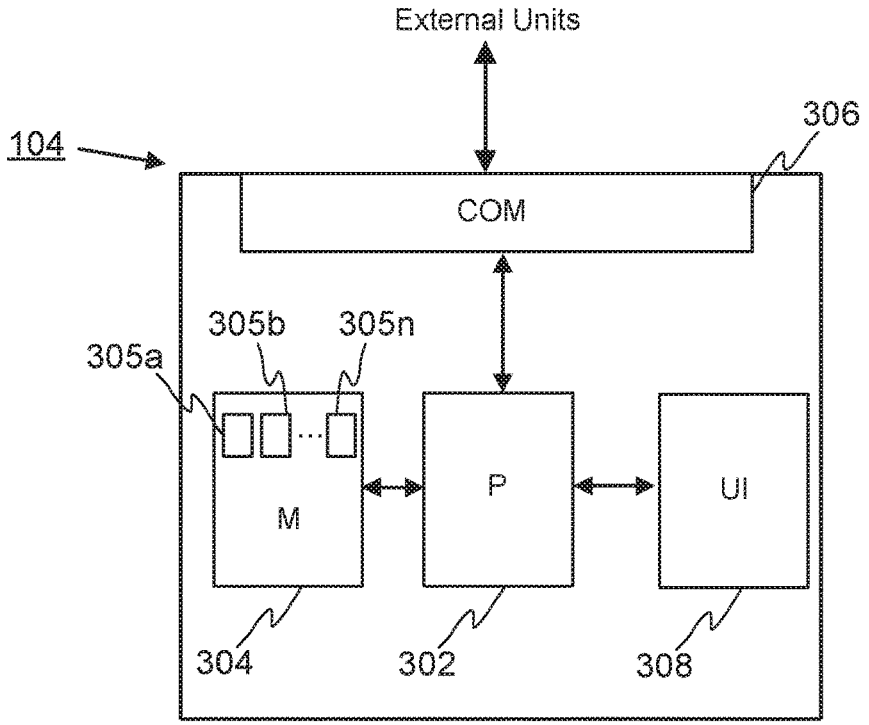
FIG. 3 illustrates schematically an example of the safety control unit according to the invention.

A schematic example of the safety control unit 104 according to the invention is disclosed in FIG. 3. The safety control unit 104 may comprise one or more processors 302, one or more memories 304 being volatile or non-volatile for storing portions of computer program code 305*a*-305*n* and any data values, a communication interface 306 and possibly one or more user interface units 308. The mentioned elements may be communicatively coupled to each other with e.g. an internal bus. The communication interface 306 provides interface for communication with any external unit, such as sensor unit 106, 108, safety device 110, database and/or external systems. The communication interface 206 may be based on one or more known communication technologies, either wired or wireless, in order to exchange pieces of information as described earlier.

The processor 302 of the safety control unit 104 is at least configured to implement at least some method steps as described. The implementation of the method may be achieved by arranging the processor 302 to execute at least some portion of computer program code 305*a*-305*n* stored in the memory 304 causing the processor 302, and thus the safety control unit 104, to implement one or more method steps as described. The processor 302 is thus arranged to access the memory 304 and retrieve and store any information therefrom and thereto. For sake of clarity, the processor 302 herein refers to any unit suitable for processing information and control the operation of the safety control unit 104, among other tasks. The operations may also be implemented with a microcontroller solution with embedded software. Similarly, the memory 304 is not limited to a certain type of memory only, but any memory type suitable for storing the described pieces of information may be applied in the context of the present invention.

Figure 4A:
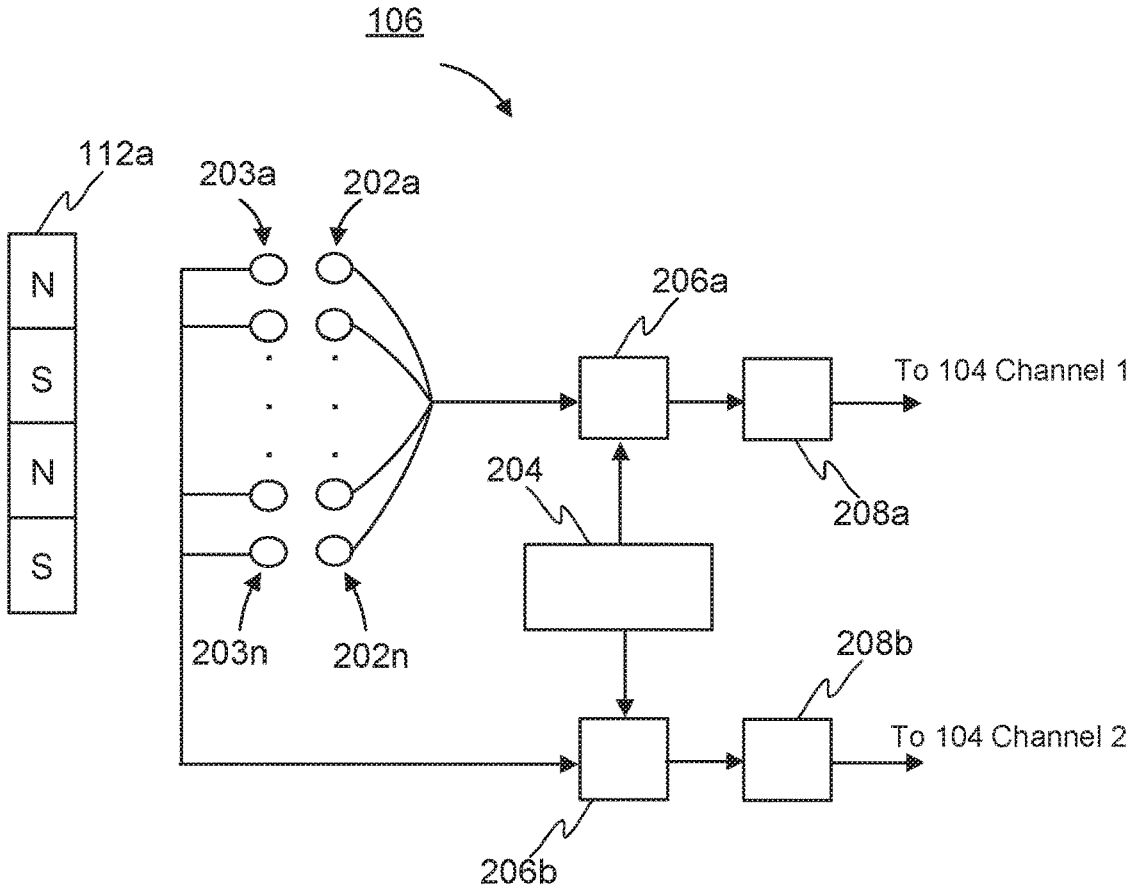
FIG. 4A illustrates schematically an example of the sensor unit according to the invention.
Figure 4B:
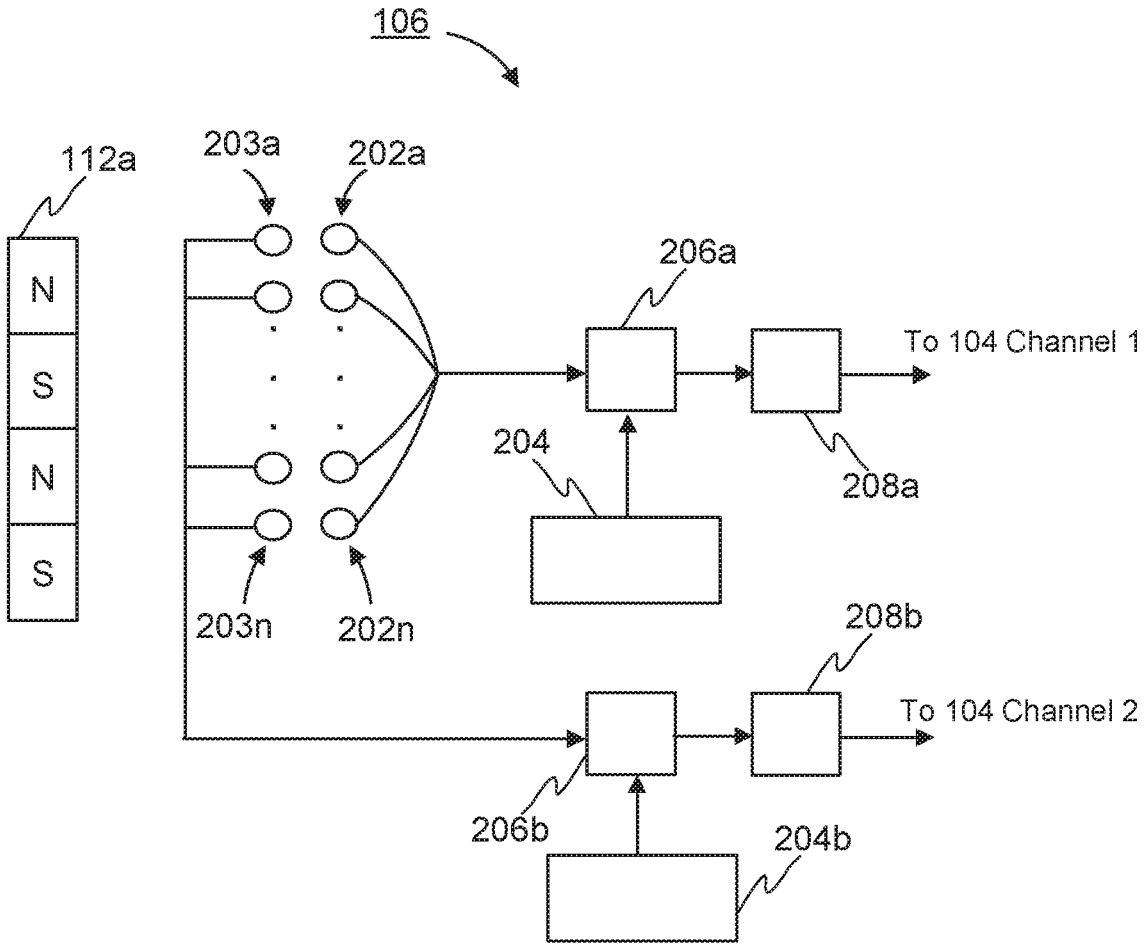
FIG. 4B illustrates schematically another example of the sensor unit according to the invention.

As described earlier the elevator system 100 according to the invention may comprise at least one sensor unit 106, 108. The at least one sensor unit may be fixed to the elevator car 102 as the sensor unit 106 in FIG. 1. Additionally, at least one sensor unit may be mounted in a hoisting motor as the sensor unit 108 in FIG. 1. FIG. 4A schematically illustrates a simplified view of an example sensor unit 106 that may be fixed to the elevator car. One sensor unit 106 may comprise at least one Hall sensor 202*a*-202*n*, 203*a*-203*n* at each channel and at least one accelerometer 204 as illustrated in FIG. 4A. Alternatively, one sensor unit 106 that may be fixed to the elevator car may comprise the at least one Hall sensor 202*a*-202*n*, 203*a*-203*n* at each channel and another sensor unit 106 that may be fixed to the elevator car may comprise the at least one accelerometer 204, for example. The number of Hall sensors 202*a*-202*n*, 203*a*-203*n* at each channel may be determined based on the number of the magnets at the door zone of each landing 112*a*-112*n*. As described the at least one continuous speed data may be obtained at both channels by means of one accelerometer 204, for example, as illustrated in FIG. 4A. Alternatively, the sensor unit 106 may comprise one accelerometer 204 at channel one and another accelerometer 204*b* at channel two as presented in FIG. 4B. The at least one magnet 112*a* is illustrated in FIGS. 4A and 4B in order to emphasize that the zone speed of the elevator car 102 may be obtained by means of the at least one Hall sensor 202*a*-202*n*, 203*a*-203*n* and the at least one magnet 112-112*n*, even though the at least one magnet 112*a*-112*n* is not a part of the sensor unit 106. The at least one magnet 112*a*-112*n* may be fixed to the elevator shaft as described earlier.

Alternatively or in addition, the sensor unit 106 may further comprise at least one processor 206*a*, 206*b* at each channel to provide the speed data of the elevator car at each channel. Alternatively, the sensor unit 106 may comprise one common processor to provide the speed data of the elevator car at the both channels. For sake of clarity, the at least one processor 206*a*, 206*b* herein refers to any unit suitable for processing information and control the operation of the sensor unit 106, among other tasks. The operations may also be implemented with a microcontroller solution with embedded software.

Alternatively or in addition, the sensor unit 106 may further comprise at least one serial bus 208*a*, 208*b*, at each channel to communicatively couple the sensor unit 106 to the safety control unit 104. Furthermore, the sensor unit 106 may comprise one or more memories being volatile or non-volatile for storing portions of computer program code and any data values. The memory is not limited to a certain type of memory only, but any memory type suitable for storing the pieces of information may be applied in the context of the present invention.

The verb "match" in context of comparison is used in this patent application to mean that the data values under comparison differ from each other less than a predetermined limit. The predetermined limit may be defined so that a desirable SIL level may be reached, for example.

The verb "mismatch" in context of comparison is used in this patent application to mean that the data values under comparison differ from each other more than the predetermined limit.

The verb "meet" in context of an overspeed limit is used in this patent application to mean that a predefined condition is fulfilled. For example, the predefined condition may be that the overspeed limit is reached and/or exceeded.

The present invention as hereby described provides great advantages over the prior art solutions. For example, the present invention improves at least partly the safety of the elevators. Furthermore, the present invention enables two-channel SIL3 level overspeed monitoring of the elevator car during a service drive and an electrical rescue drive function (RDF).

The specific examples provided in the description given above should not be construed as limiting the applicability and/or the interpretation of the appended claims. Lists and groups of examples provided in the description given above are not exhaustive unless otherwise explicitly stated.

The invention claimed is:

1. A method for verifying speed data of an elevator car for overspeed monitoring of the elevator car, the method comprising:

obtaining at least one continuous speed data of the elevator car at two channels, obtaining a zone speed data of the elevator car within at least one zone of an elevator shaft at two channels, generating a two-channel verified speed information by verifying the validity of the at least one continuous speed data by comparing the said at least one continuous speed data to the zone speed data at least at one channel, preferably at both channels, when the zone speed data is available, generating a control signal for a safety device, if the comparison indicates a mismatch between the zone speed data and the at least one continuous speed data at least at one channel in which the comparison is provided, and if the comparison indicates a match between the zone speed data and the at least one continuous speed data at each of the at least one channel in which the comparison is provided, the method further comprising:

comparing the verified speed information at each channel between each other by reciprocal comparison, and generating the control signal for the safety device, if the reciprocal comparison indicates a mismatch between the verified speed information at the channels.

2. The method according to claim 1, wherein, if the reciprocal comparison indicates a match between the verified speed information at the channels, the method further comprising:

determining if the verified speed information meets a predetermined overspeed limit at least at one channel, and generating the control signal for the safety device, if the verified speed data meets the predetermined overspeed limit at least at one channel.

3. The method according to claim 1, wherein, if two or more continuous speed data of the elevator car at least at one channel are obtained, the method further comprising:

comparing continuously the two or more continuous speed data with each other at least at one channel, and generating the control signal for the safety device, if the comparison indicates a mismatch between the two or more continuous speed data at least at one channel.

4. The method according to claim 1, wherein the zone speed data is obtained by means of at least one Hall sensor at each channel and at least one magnet at the zone.

5. The method according to claim 1, wherein the at least one zone of the elevator shaft is a door zone.

6. The method according to claim 1, wherein the at least one continuous speed data of the elevator car is obtained by means of at least one of the following: at least one accelerometer, at least one encoder mounted in a hoisting motor.

7. The method according to claim 1, wherein the control signal comprises an instruction to stop the movement of the elevator car.

8. A safety control unit for verifying speed data of an elevator car for overspeed monitoring of the elevator car, wherein the safety control unit is communicatively coupled to a safety device, the safety control unit comprising:

at least one processor, and at least one memory storing at least one portion of computer program code, wherein the at least one processor being configured to cause the elevator control unit at least to perform:

obtain at least one continuous speed data of the elevator car at two channels, obtain a zone speed data of the elevator car within at least one zone of an elevator shaft at two channels, generate a two-channel verified speed information by verifying the validity of the at least one continuous speed data by comparing the said at least one continuous speed data to the zone speed data at least at one channel, preferably at both channels, when the zone speed data is available, generate a control signal for a safety device, if the comparison indicates a mismatch between the zone speed data and the at least one continuous speed data at least at one channel in which the comparison is provided, and if the comparison indicates a match between the zone speed data and the at least one continuous speed data at each of the at least one channel in which the comparison is provided, the safety control unit is further configured to:

compare the verified speed information at each channel between each other by reciprocal comparison, and generate the control signal for the safety device, if the reciprocal comparison indicates a mismatch between the verified speed information at the channels.

9. The safety control unit according to claim 8, wherein if the reciprocal comparison indicates a match between the verified speed information at the channels, the safety control unit is further configured to:

determine if the verified speed information meets a predetermined overspeed limit at least at one channel, and generate the control signal for the safety device, if the verified speed data meets the predetermined overspeed limit at least at one channel.

10. The safety control unit according to claim 8, wherein, if two or more continuous speed data of the elevator car at least at one channel are obtained, the safety control unit is further configured to:

compare continuously the two or more continuous speed data with each other at least at one channel, and generate the control signal for the safety device, if the comparison indicates a mismatch between the two or more continuous speed data at least at one channel.

11. The safety control unit according to claim 8, wherein the zone speed data is determined by means of at least one Hall sensor at each channel and at least one magnet at the zone.

12. The safety control unit according to claim 8, wherein the at least one zone of the elevator shaft is a door zone.

13. The safety control unit according to claim 8, wherein the obtained at least one continuous speed data of the elevator car is obtained by means of at least one of the following: at least one accelerometer, at least one encoder mounted in a hoisting motor.

14. The safety control unit according to claim 8, wherein the control signal comprises an instruction to stop the movement of the elevator car.

15. An elevator system for verifying speed data of an elevator car for overspeed monitoring of the elevator car, the elevator system comprising:

a safety device for controlling the movement of the elevator car, at least one sensor unit, a safety control unit configured to:

obtain at least one continuous speed data of the elevator car at two channels from at least one sensor unit, obtain a zone speed data of the elevator car within at least one zone of an elevator shaft at two channels from at least one sensor unit, generate a two-channel verified speed information by verifying the validity of the at least one continuous speed data by comparing the said at least one continuous speed data to the zone speed data at least at one channel, preferably at both channels, when the zone speed data is available, generate a control signal for the safety device, if the comparison indicates a mismatch between the zone speed data and the at least one continuous speed data at least at one channel in which the comparison is provided, and if the comparison indicates a match between the zone speed data and the at least one continuous speed data at each of the at least one channel in which the comparison is provided, the safety control unit is further configured to:

compare the verified speed information at each channel between each other by reciprocal comparison, and generate the control signal for the safety device, if the reciprocal comparison indicates a mismatch between the verified speed information at the channels, wherein the safety control unit, the at least one sensor unit and the safety device are communicatively coupled to each other, and wherein the safety control unit is configured to deliver the generated control signal to the safety device.

* * * * *